US008443988B2

(12) United States Patent
Niederhuefner

(10) Patent No.: US 8,443,988 B2
(45) Date of Patent: May 21, 2013

(54) ALARM SOUNDING RETAIL DISPLAY SYSTEM

(75) Inventor: Joerg Niederhuefner, Altenmedingen (DE)

(73) Assignee: Southern Imperial, Inc., Rockford, IL (US)

( * ) Notice: Subject to any disclaimer, the term of this patent is extended or adjusted under 35 U.S.C. 154(b) by 321 days.

(21) Appl. No.: 12/717,277

(22) Filed: Mar. 4, 2010

(65) Prior Publication Data

US 2011/0215060 A1 Sep. 8, 2011

(51) Int. Cl.
*A47F 1/04* (2006.01)

(52) U.S. Cl.
USPC ..... 211/59.3; 211/183; 248/551; 340/568.8

(58) Field of Classification Search
USPC ..... 211/59.2, 59.3, 183, 184; 248/551, 248/550; 700/231, 236, 217; 705/22, 28; 340/568.1, 568.2, 568.8, 571, 572.8
See application file for complete search history.

(56) References Cited

U.S. PATENT DOCUMENTS

| | | | |
|---|---|---|---|
| 3,848,745 | A | 11/1974 | Smith |
| 4,289,242 | A | 9/1981 | Kenyon |
| 4,475,658 | A | 10/1984 | Roberts |
| 4,712,694 | A | 12/1987 | Breslow |
| 4,742,923 | A | 5/1988 | Calvert |
| 4,821,894 | A | 4/1989 | Dechirot |
| 4,830,201 | A | 5/1989 | Breslow |
| 4,836,390 | A | 6/1989 | Polvere |
| 4,887,737 | A | 12/1989 | Adenau |
| 4,899,668 | A | 2/1990 | Valiulis |
| 4,901,869 | A | 2/1990 | Hawkinson et al. |
| 5,009,334 | A | 4/1991 | Bodkins |
| 5,083,638 | A | 1/1992 | Schneider |
| 5,114,021 | A | 5/1992 | Fredrickson |
| 5,161,704 | A | 11/1992 | Valiulis |
| 5,222,608 | A | 6/1993 | Eklof et al. |
| 5,240,126 | A | 8/1993 | Foster et al. |
| 5,265,738 | A | 11/1993 | Yablans et al. |
| 5,641,077 | A | 6/1997 | Tufano et al. |
| 5,671,851 | A | 9/1997 | Johnson et al. |
| 5,685,664 | A | 11/1997 | Parham et al. |
| 5,690,238 | A | 11/1997 | Schmehr |

(Continued)

FOREIGN PATENT DOCUMENTS

| | | | |
|---|---|---|---|
| DE | 20 2005 010 088 | U1 | 10/2005 |
| EP | 0 868 871 | A1 | 10/1998 |

(Continued)

OTHER PUBLICATIONS

U.S. Appl. No. 12/718,015, filed Mar. 5, 2010, Niederhuefner et al.

(Continued)

*Primary Examiner* — Korie H Chan
(74) *Attorney, Agent, or Firm* — Reinhart Boerner Van Deuren P.C.

(57) ABSTRACT

An alarm sounding retail display system is provided. The alarm sounding retail display system is operable to provide an audible tone upon the movement of retail merchandise carried within the retail display system. The audible provides an indication of enhanced security and can alert store employees in proximity to the retail display system that merchandise has been added to or removed from the retail display system.

11 Claims, 18 Drawing Sheets

U.S. PATENT DOCUMENTS

| | | | | |
|---|---|---|---|---|
| 5,730,320 | A * | 3/1998 | David | 221/279 |
| 5,839,588 | A | 11/1998 | Hawkinson | |
| 5,855,282 | A | 1/1999 | Hardy | |
| 5,906,283 | A | 5/1999 | Kump et al. | |
| 5,971,173 | A | 10/1999 | Valiulis et al. | |
| 6,041,720 | A | 3/2000 | Hardy | |
| 6,082,558 | A | 7/2000 | Battaglia | |
| 6,102,192 | A | 8/2000 | Tomuro et al. | |
| 6,105,791 | A | 8/2000 | Chalson et al. | |
| 6,109,458 | A | 8/2000 | Walsh et al. | |
| 6,129,218 | A | 10/2000 | Henry et al. | |
| 6,131,748 | A | 10/2000 | Kawasaki et al. | |
| 6,158,598 | A | 12/2000 | Josefsson | |
| 6,269,285 | B1 | 7/2001 | Mignault | |
| 6,286,690 | B1 | 9/2001 | Thalenfeld | |
| 6,409,028 | B2 | 6/2002 | Nickerson | |
| 6,474,478 | B1 | 11/2002 | Huehner et al. | |
| D472,331 | S | 3/2003 | Zadak et al. | |
| D480,231 | S | 10/2003 | Valiulis et al. | |
| 6,659,291 | B2 | 12/2003 | Huehner et al. | |
| 6,769,552 | B1 | 8/2004 | Thalenfeld | |
| 6,820,754 | B2 | 11/2004 | Ondrasik | |
| 6,824,009 | B2 | 11/2004 | Hardy | |
| 6,874,684 | B1 | 4/2005 | Denenberg et al. | |
| 6,886,699 | B2 | 5/2005 | Johnson et al. | |
| 6,889,854 | B2 | 5/2005 | Burke | |
| 6,923,330 | B1 | 8/2005 | Nagel | |
| 6,964,235 | B2 | 11/2005 | Hardy | |
| 7,007,810 | B2 | 3/2006 | Huehner et al. | |
| 7,293,663 | B2 | 11/2007 | Lavery | |
| 7,395,938 | B2 | 7/2008 | Merit et al. | |
| 7,533,784 | B2 | 5/2009 | Vlastakis et al. | |
| 7,566,037 | B2 | 7/2009 | Vogler | |
| 7,768,399 | B2 | 8/2010 | Hachmann et al. | |
| 7,792,711 | B2 * | 9/2010 | Swafford et al. | 705/28 |
| 7,905,364 | B2 | 3/2011 | Pail | |
| 2001/0002210 | A1 | 5/2001 | Petite | |
| 2001/0044751 | A1 | 11/2001 | Pugliese, III et al. | |
| 2002/0004690 | A1 | 1/2002 | Paulucci et al. | |
| 2002/0108916 | A1 | 8/2002 | Nickerson | |
| 2003/0004784 | A1 | 1/2003 | Li et al. | |
| 2003/0029816 | A1 | 2/2003 | Huehner et al. | |
| 2003/0057167 | A1 | 3/2003 | Johnson et al. | |
| 2004/0034581 | A1 | 2/2004 | Hill et al. | |
| 2004/0073334 | A1 | 4/2004 | Terranova | |
| 2004/0084386 | A1 | 5/2004 | Huehner et al. | |
| 2004/0124201 | A1 | 7/2004 | Hieb | |
| 2005/0040123 | A1 | 2/2005 | Ali | |
| 2005/0056602 | A1 | 3/2005 | Hardy | |
| 2005/0098626 | A1 | 5/2005 | Jordan et al. | |
| 2005/0168345 | A1 | 8/2005 | Swafford, Jr. et al. | |
| 2005/0189309 | A1 | 9/2005 | Hardy | |
| 2005/0189369 | A1 * | 9/2005 | Vlastakis et al. | 221/123 |
| 2005/0279722 | A1 | 12/2005 | Ali | |
| 2006/0049122 | A1 | 3/2006 | Mueller et al. | |
| 2006/0219517 | A1 | 10/2006 | Cheng et al. | |
| 2006/0226095 | A1 | 10/2006 | Hardy | |
| 2007/0050271 | A1 | 3/2007 | Ufford et al. | |
| 2007/0095903 | A1 | 5/2007 | Suenbuel | |
| 2007/0251900 | A1 | 11/2007 | Hardy | |
| 2007/0267364 | A1 | 11/2007 | Barkdoll | |
| 2007/0267367 | A1 | 11/2007 | Mueller et al. | |
| 2007/0273513 | A1 * | 11/2007 | White | 340/568.8 |
| 2008/0015956 | A1 | 1/2008 | Regard | |
| 2008/0203253 | A1 | 8/2008 | Vogler | |
| 2008/0309489 | A1 | 12/2008 | Hachmann et al. | |
| 2009/0006196 | A1 | 1/2009 | Barkan et al. | |
| 2009/0101606 | A1 | 4/2009 | Olson | |
| 2009/0248198 | A1 * | 10/2009 | Siegel et al. | 700/231 |
| 2010/0012602 | A1 | 1/2010 | Valiulis | |
| 2010/0268792 | A1 | 10/2010 | Butler et al. | |
| 2011/0282768 | A1 * | 11/2011 | Swafford et al. | 705/28 |

FOREIGN PATENT DOCUMENTS

| | | | |
|---|---|---|---|
| EP | 1 256 296 | A2 | 11/2002 |
| EP | 1 541 064 | A1 | 6/2005 |
| EP | 1 541 064 | B1 | 2/2006 |
| GB | 2 304 102 | A | 3/1997 |
| GB | 2 360 514 | A | 9/2001 |
| NL | 1001794 | C2 | 6/1997 |
| WO | WO 91/03967 | A1 | 4/1991 |
| WO | WO 2004/083051 | A2 | 9/2004 |

OTHER PUBLICATIONS

U.S. Appl. No. 12/718,737, filed Mar. 5, 2010, Westberg et al.
U.S. Appl. No. 12/369,120, filed Feb. 11, 2009, Barkdoll.

* cited by examiner

ALARM SOUNDING RETAIL DISPLAY SYSTEM

FIELD OF THE INVENTION

This invention generally relates to retail display systems, and more particularly to retail display systems incorporating loss prevention measures.

BACKGROUND OF THE INVENTION

Retail theft is an ongoing problem in retail environments. As retail theft increases, retail profits decrease. As a result, retailers often times must increase the price of merchandise to maintain profitability. Accordingly, retail theft affects retailers and consumers alike, and various loss prevention measures have been employed in various retail environments and retail display systems to reduce retail theft.

One type of retail display system, a pusher system, has been used for some time in various retail markets for facing products, i.e. biasing the products towards the consumer in a neat and organized manner. It is generally accepted that facing products can increase retail sales, and as a result, many retail stores now incorporate pusher systems for various merchandise. A typical pusher system uses a pusher to bias products forward. The pusher is typically biased forward by a biasing element such as a coil spring, connected to a leading edge of a shelf or other structure. Retail products are contained between the leading edge of the shelf or other structure and the pusher so that as the pusher is biased forward, so too are the retail products. Dividers are often used to separate rows of merchandise contained in multiple pusher systems arranged in parallel to one another. As a leading item of merchandise is removed, the pusher biases the row forward, so that the next item is now the leading item.

Another type of retail display system, a gravity fed system, has also been used for some time for facing products. A gravity fed system is similar to a pusher system with the exception that it relies upon gravity to bias merchandise forward as opposed to a pusher. Gravity feed systems are typically located on an angled shelf, and contain merchandise therein in a line or row. As a leading item of merchandise is removed, gravity biases the remaining products forward, so that the next item of merchandise is now the leading item.

Pusher and gravity feed systems, i.e. self facing merchandisers, like many other retail display systems, are subject to retail theft attempts. Indeed, these systems do not ordinarily contain additional security devices or measures, and as a result, products can simply be removed from the systems in a retail theft scenario. This problem is particularly acute where higher value products are contained by the system. In response, many retailers have incorporated additional external security measures.

One such security measure used in the past has been to lock the entire system(s) in a case. When a consumer wishes to remove an item from the system, a store employee must open the case and remove the item for the consumer. Unfortunately, it has been shown that such a configuration can reduce retail sales. Consumers can grow impatient waiting for a store employee to unlock the case when an employee is not readily available. Often times, the consumer will abandon their previously formed intention to purchase the product within the case, as the consumer simply grows tired of waiting.

There exists, therefore, a need in the art for a retail display system that provides additional loss prevention measures without sacrificing consumer access and the sales generated thereby, unlike the systems described above. The invention provides such a pusher system. These and other advantages of the invention, as well as additional inventive features, will be apparent from the description of the invention provided herein.

BRIEF SUMMARY OF THE INVENTION

The present invention has several aspects that may be claimed and stand as patentable independently and individually or in combination with other aspects. Some aspects are summarized below, while others may be developed in the remainder of the disclosure.

In one aspect, embodiments of the invention provide a retail display system including an alarm sounding pusher system that provides an audible tone upon the movement of a pusher. An embodiment of this aspect of the invention includes a pusher movable for facing retail merchandise and a tone generation module in electrical communication with the pusher. The tone generation module is operable to provide an audible tone upon removal of one or more items of merchandise from the retail display system.

In a subsidiary embodiment, the tone generation module is in electrical communication with the pusher. A movement of the pusher causes a change of state in an electrical circuit formed between the pusher and the tone generation module. The tone generation module is operable to provide the audible tone upon the change of state.

In another aspect, embodiments of the invention provide a retail display system that includes a self facing merchandiser that provides an audible notification upon the removal of merchandise therefrom. The retail merchandiser is configured to self face retail merchandise toward a front of a shelf. A tone generation module is operable to provide an audible tone upon removal of one or more items of merchandise from the self facing merchandiser and generally any time one or more items of merchandise is removed.

In a subsidiary embodiment, the tone generation module is connected to a sensor that is adapted to sense withdrawal of a leading one of the items of merchandise on the shelf. The self facing merchandiser can be a pusher that is movable for facing retail merchandise. The tone generation module is in electrical communication with the pusher via a senor and is operable to provide an audible tone upon removal of one or more items of merchandise from the retail display system due to movement of the pusher.

In another aspect, embodiments of the invention provide a retail display system system that intermittently opens and closes an electrical circuit. An embodiment of a pusher system according to this aspect includes a pusher having a first contact and a track providing a second contact. The pusher is slidable along the track. The first and second contacts intermittently align and misalign as the pusher slides along the track. A tone generation module is in communication with at least one of the first and second contacts and is operable to provide an audible tone upon the intermittent alignment and misalignment of the first and second contacts.

In a subsidiary embodiment, the first contact extends from a bottom of the pusher and the track has an opening configured to receive the first contact. The second contact is carried within a pocket of the track. The first contact extends through the opening and into the pocket to contact the second contact. The second contact can be a contact board that has a first and a second contact strip carried by a non-conductive base of the contact board. The first contact strip can be a continuous strip of conductive material and the second contact strip can also be a strip of conductive material. The second contact strip can have a base portion and a plurality of spaced apart extensions with a portion of the non-conductive base disposed between adjacent spaced apart extensions of the plurality of extensions.

Other embodiments of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
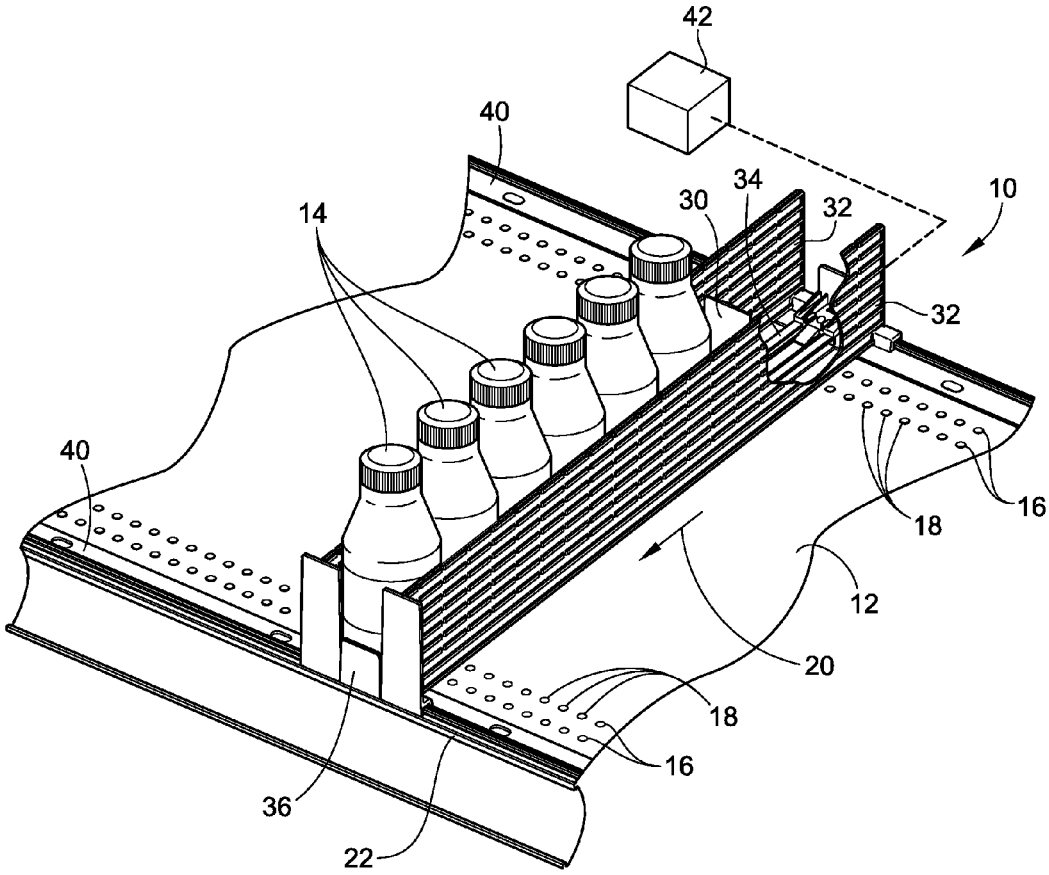
FIG. 1 is a perspective view of an exemplary embodiment of an alarm sounding retail display system in accordance with the teachings of the present invention.

Referring now to FIG. 1, a retail display system embodied as an alarm sounding pusher system 10 is illustrated in a typical retail environment. The alarm sounding pusher system 10 is situated on a retail shelf 12, and carries retail merchandise 14 therein. As is generally known in the art, the shelf 12 incorporates rows 16 of apertures 18 for mounting the pusher system 10 thereto. The merchandise 14 is biased toward a front edge 22 of the shelf 12 in a facing direction 20. As a front most item of retail merchandise 14 is removed, the next adjacent item of retail merchandise 14 is biased forward by the pusher system 10.

While such an exemplary retail embodiment is provided, it will be recognized from the following that embodiments of the invention may be implemented in various other retail environments.

In the illustrated embodiment, the alarm sounding pusher 10 includes a pusher 30 interposed between a pair of dividers 32. The pusher 30 rides upon and is guided by a track 34. A pair of end caps 36 close either end of the track 34. The pusher 30 contains a biasing element 38 (see FIG. 2) connected to one of the end caps 36. The biasing element 38 biases the pusher 30 towards the leading edge 22 of the shelf 12. The dividers 32 and end caps 36 connect to front and rear shelf mounts 40. The shelf mounts 40 are connected to the shelf 12 using the rows 16 of apertures 18. The dividers 32 and end caps 36 connect to the shelf mounts 40 such that the alarm sounding pusher system 10 is maintained upon the shelf 12 in a generally rigid and structurally sound state.

The alarm sounding pusher system 10 also includes a tone generation module 42. As will be discussed in greater detail below, the tone generation module 42 is operable to provide an audible tone upon a movement of the pusher 30 along the shelf 12. It will be recognized that the audible tone provided by the tone generation module 42 can discourage attempts of retail theft from the alarm sounding pusher system 10 because it presents an indication of potential additional security systems associated with the alarm sounding pusher system 10. The audible tone provided by the tone generation module 42 can also deter attempts of retail theft from the alarm sounding pusher system 10 because nearby employees hearing the audible tone can monitor the alarm sounding pusher system 10 for any theft activity.

It will be recognized from the following disclosure that the advantages of the tone generation module 42 discussed above are not limited to the illustrated alarm sounding pusher system 10 of FIG. 1. To the contrary, the tone generation module 42 can provide the above advantages in various types of pusher systems and is not limited to the illustrated embodiment of FIG. 1.

Figure 2:
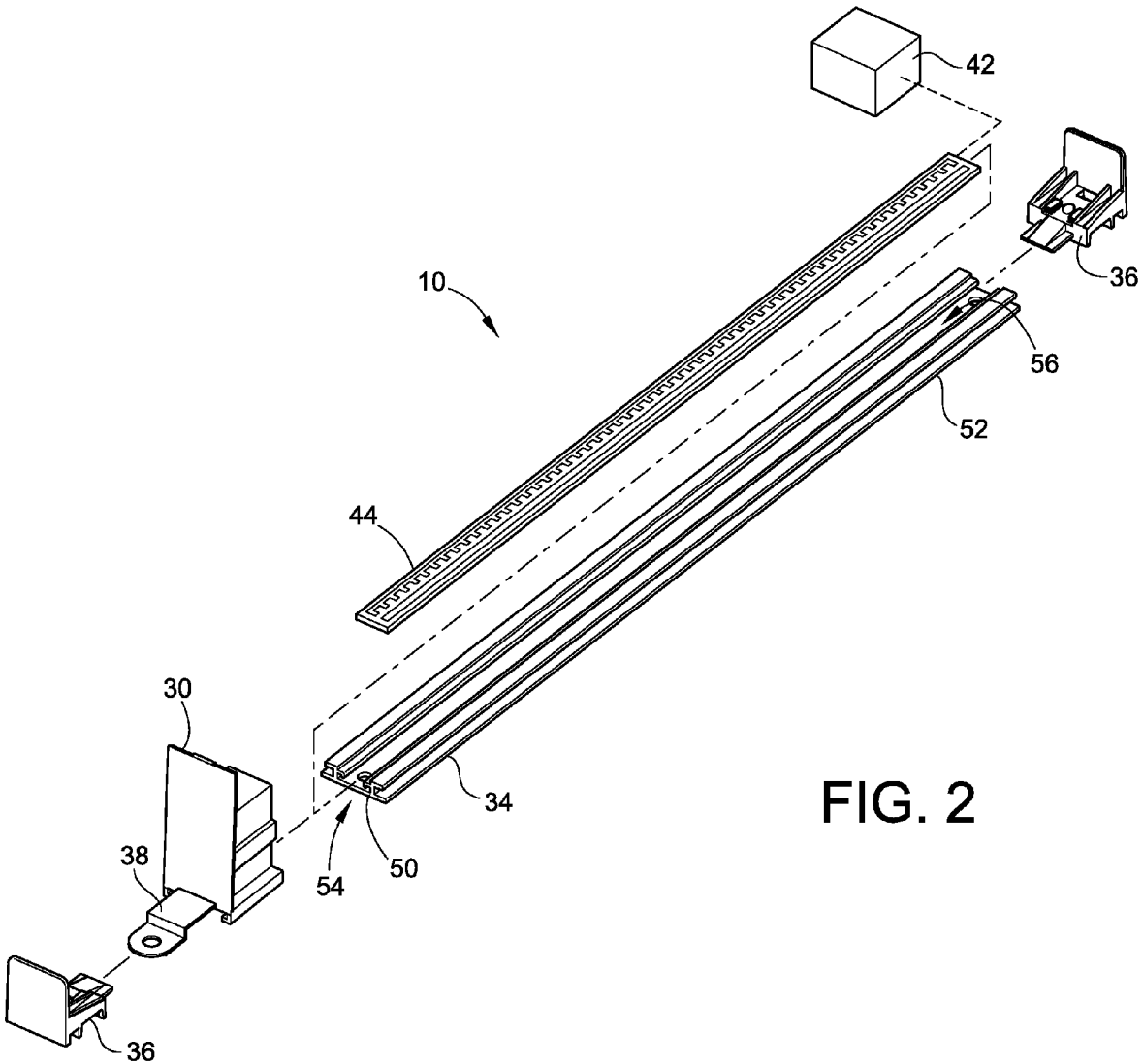
FIG. 2 is a perspective exploded view of the embodiment of FIG. 1.

Turning now to FIG. 2, the above advantages and benefits of the tone generation module 42 are accomplished in part by the incorporation of a contact board 44 within the alarm sounding pusher system 10. The contact board 44 is contained within the track 34. The contact board 44 is in electrical communication with the tone generation module 42. The end caps 36 maintain the contact board 44 in place within the track 34.

As will be discussed in greater detail below, the pusher 30 has a first contact and rides along the track 34 making contact with a second contact formed by the contact board 44. More specifically, the pusher 30, as it moves along the track 34, opens and closes an electrical circuit incorporating the contact board 44 and tone generation module 42. Accordingly, the first and second contacts form a sensor that senses movement of the pusher upon removal or withdrawal of retail merchandise. As will be more fully understood from the following, the sensor can take the form of various other structures not necessarily limited to first and second contacts.

In one embodiment the tone generation module 42 is operable to provide an audible tone when the circuit is in an open state. In another embodiment, the tone generation module 42 is operable to provide an audible tone when the circuit is in a closed state. In yet another embodiment, the tone generation module is operable to provide an audible tone upon detecting a change in state from open to close or from close to open of the electrical circuit. In further embodiments, the tone generation module 42 in combination with the contact board 44 and pusher 30 are operable to provide an audible tone under various other conditions.

The track 34 is an elongated member that extends between first and second ends 50, 52. The track 34 defines a pocket 54 for containment of the contact board 44. The pusher 30 can engage the contact board 44 contained within the pocket 54 through an open bottomed channel 56 of the track 34.

Figure 3:
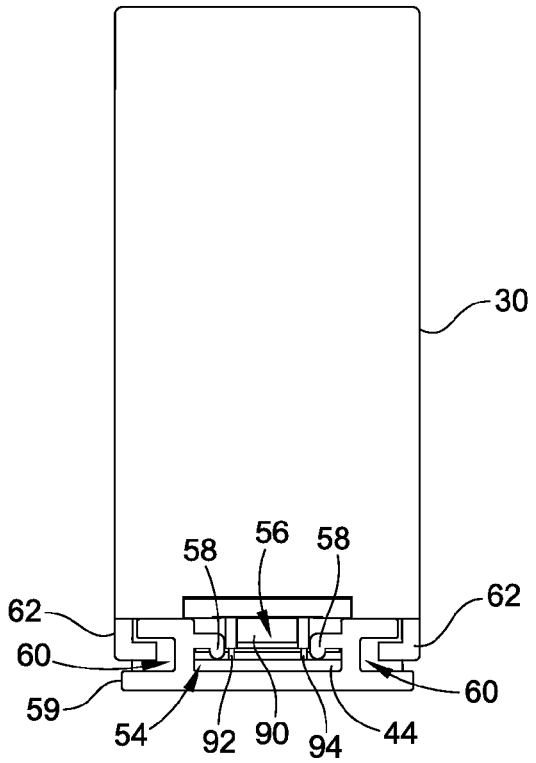
FIG. 3 is a front view of a pusher, contact board, and a track of the embodiment of FIG. 1.

Turning now to FIG. 3, the track 34 also includes a pair of down turned flanges 58. The flanges 58 define the extremities of the open bottom channel 56 and also serve to seat the contact board 44 within the pocket 54. The track 34 has a pair of guide grooves 60 that receive inwardly extending guides 62 for aligning and guiding the pusher 30 relative to the track 34. The guides 62 are slidable within the grooves 60 of the track. It is recognized that other structures can be used to guide the pusher 30 relative to the track 34. For example, the pusher 30 and track 34 could each utilize a single guide and groove, respectively. For additional example, the guide could be part of the track 34 and the groove 60 could be part of the pusher 30.

Figure 4:
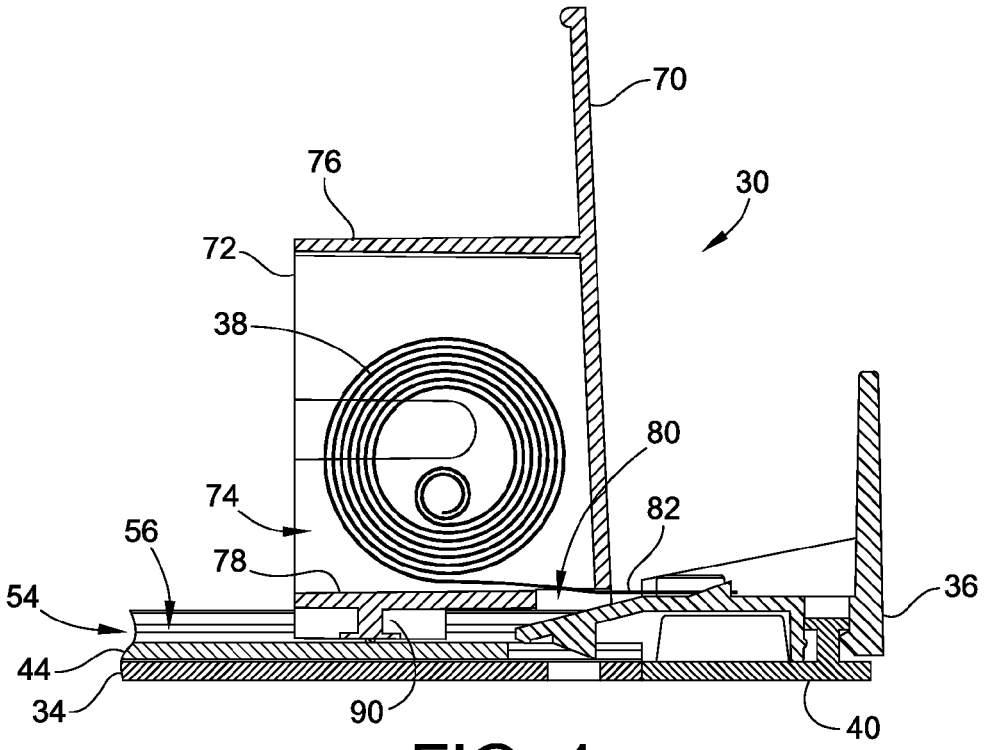
FIG. 4 is a partial side sectional view of the pusher and the track of FIG. 3.

Referring now to FIG. 4, the pusher 30 has a paddle 70 and a housing 72. As illustrated in FIG. 4 and additionally in FIG. 1, the paddle 70 makes contact with retail merchandise 14 (see FIG. 1). The housing 72 is generally a rectangular chamber having an open back 74 and extending between top and bottom walls 76, 78. The paddle 70 also forms a front of the housing 72.

The housing 72 carries the biasing element 38. In the illustrated embodiment of FIG. 4, the biasing element 38 is a coil spring. However, in other embodiments, the biasing element 38 can take the form of various other biasing elements e.g. compression springs, elastic members, etc. The bottom wall 78 of the housing 72 has an opening 80 therein for routing of an end 82 of the biasing element 38. As will be discussed in greater detail below, the end 82 of the biasing element 38 connects to one of the end caps 36. As the pusher 30 is pulled or biased away from the end cap 36, the biasing element 38 through its connection to the same end cap 36 biases the pusher 30 back toward the end cap 36.

Referring now to FIGS. 3 and 4, the pusher 30 also includes a contact structure 90 extending from a bottom of the pusher 30. The contact structure 90 carries a first contact member 92 and a second contact member 94. As will be discussed in greater detail below, the first and second contact members 92, 94 make contact with the contact board 44 to open and close a circuit with the tone generation module 42 (see FIG. 1). The contact structure 90 carrying the first and second contact members 92, 94 extends through the open bottom channel 56 into the pocket 54 to contact the contact board 44.

Figure 5:
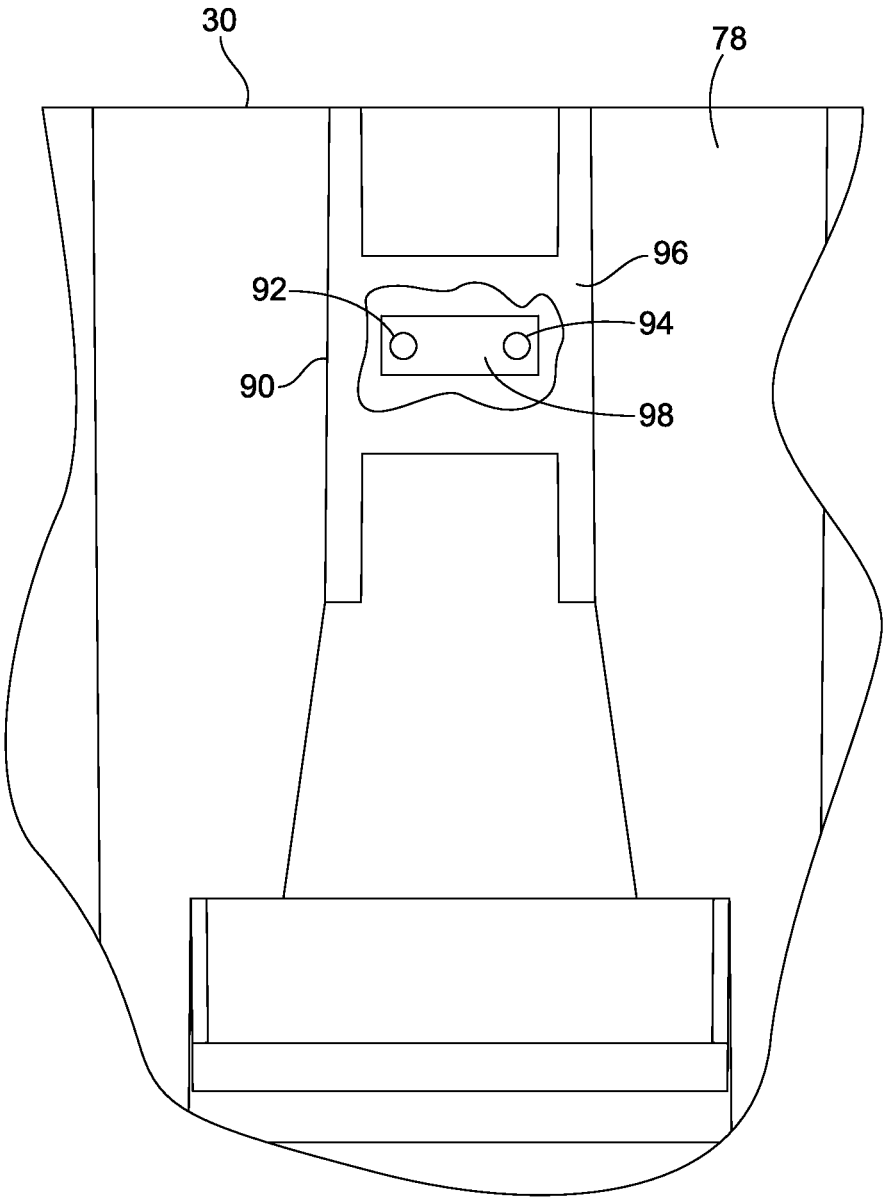
FIG. 5 is a bottom view of a contact structure of the pusher of FIG. 3.

With reference to FIG. 5, the first and second contact members 92, 94 extend through a bottom surface 96 of the contact structure 90 (see also FIG. 3). The contact structure 90 also carries a union 98. The union 98 conductively joins the first and second contact members 92, 94 such that electrical current can flow into the first contact member 92, across the union 98, and out of the second contact member 94, or vice versa. As a result, the first and second contact members 92, 94 and union 98 carried by the contact structure 90 can function to complete an electrical circuit with the tone generation module 42 (see FIG. 1). The first and second contact members 92, 94 can be spring loaded to better facilitate their connection between the union 98 and contact board 44. Although illustrated as utilizing several components, the first and second contact members 92, 94 and union 98 can be formed as a one piece construction. Indeed, various other configurations of the contact structure 90 are contemplated, that will achieve the benefits disclosed herein.

Figure 6:
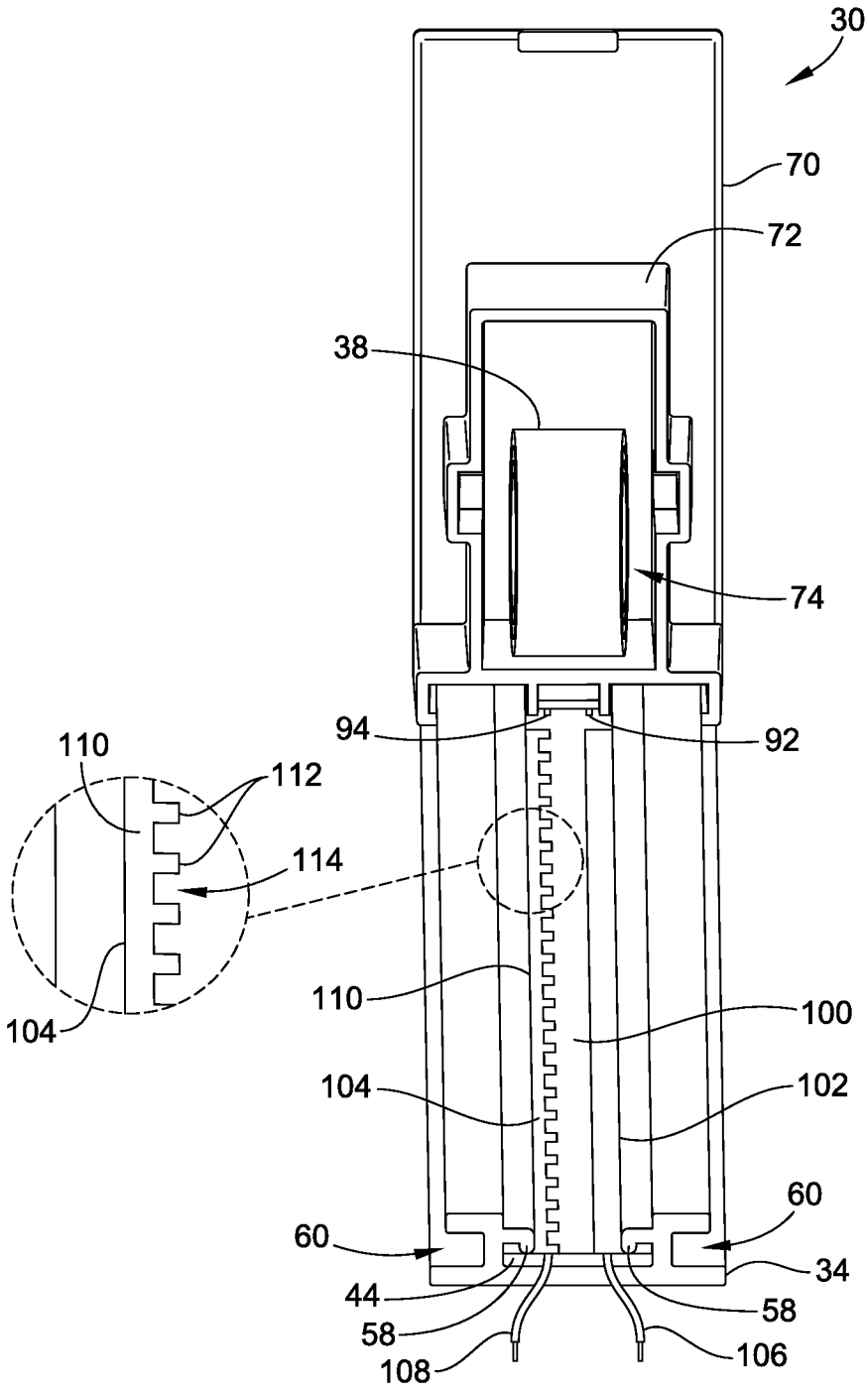
FIG. 6 is back perspective view of the pusher, contact board, and track of FIG. 3.

Turning now to FIG. 6, as discussed above, the contact board 44 resides within the track 34. The contact board 44 has a non-conductive board 100 that carries a first and second contact strip 102, 104. The first and second contact strips 102, 104 are electrically insulated from one another by way of the non-conductive board 100. The first contact strip 102 has a first lead wire 106 extending from an end thereof. Similarly, the second contact strip 104 has a second lead wire 108 extending from an end thereof. The lead wires 106, 108 terminate at the tone generation module 42.

The first contact member 92 is in constant contact with the first contact strip 102. However, the second contact member 94 is in intermittent contact with the second contact strip 104 as a function of the serrated design of the second contact strip 104. More specifically, the second contact strip has a base portion 110 and a plurality of equally spaced extensions 112 extending from the base portion 110. The second contact member 94 remains out of contact with the base portion 110 during operation of the alarm sounding pusher system 10.

However, the second contact member 94 will intermittently contact the extensions 112. As a result, and as will be discussed in greater detail below, electrical current will flow between the first and second contact strips 102 and 104 when the first and second contact members 92 and 94 are aligned therewith such that the second contact member 94 is in contact with one of the plurality of extensions 112 of the second contact member 104. Likewise, electrical current will not flow between the first and second contact members 102, 104 when the second contact member 94 is aligned with an opening 114 between the extensions 112 of the second contact member 104.

While the particular configuration and design of the first and second contact strips 102, 104 are illustrated, it is recognized that various other configurations are contemplated. For example, the position of the first and second contact strips 102, 104 could be reversed. For additional example, the first and second contact strips 102, 104 could possess any other shape sufficient to achieve the functionality described herein.

Figure 7A:
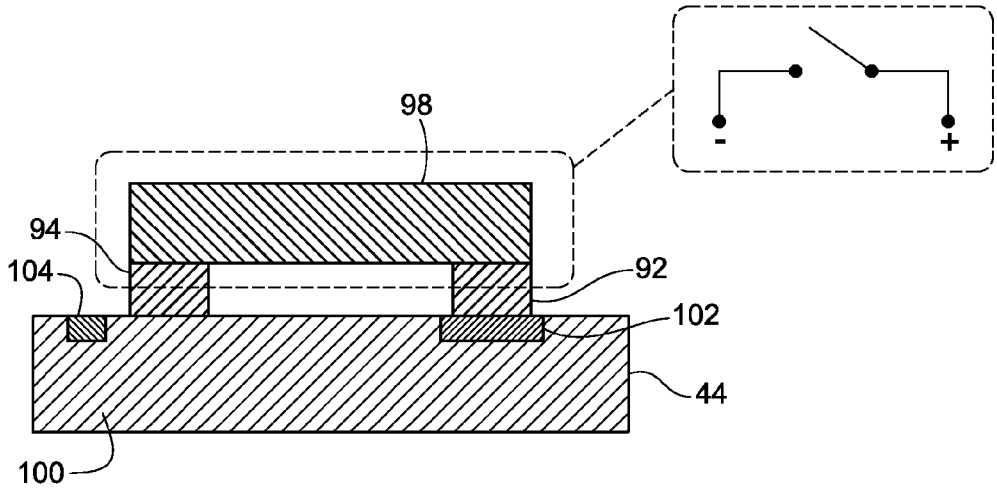
FIGS. 7A-7B are sectional views of various positions of a first and second contact member carried by the contact structure of FIG. 5 relative to the contact board of FIG. 3.
Figure 7B:
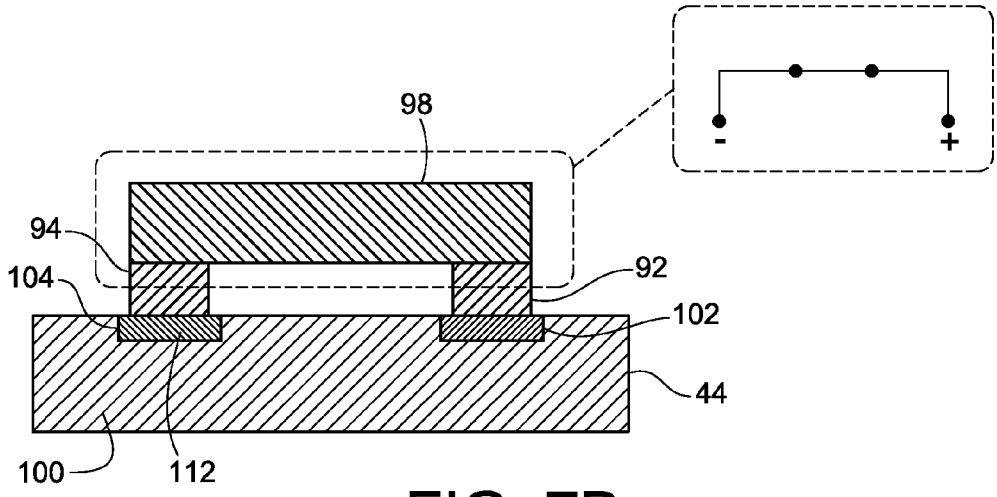

Turning now to FIGS. 7A-B, the interaction between the first and second contact members 92, 94 and the first and second contact strips 102, 104 is further illustrated. With reference to FIG. 7A, the first contact member 92 is aligned with the first contact strip 102. The second contact member 94 is within an opening 114 of the second contact strip 104, and is thus in contact with the non-conductive board 100 of the contact board 44. When this is so, current cannot flow between the first contact member 92 and second contact member 94. The result is schematically illustrated as an opened switch or contact.

Turning now to FIG. 7B, when the first contact member 92 is aligned with the first contact strip 102 and the second contact member 94 is aligned with one extension 112 of the second contact strip 104, current will flow between the first contact member 92 through the second contact member 94, and likewise therefore through the first contact strip 102 and second contact strip 104. When this is the case, the illustrated configuration is schematically represented as a closed switch or contact. It is recognized that the above description can be reversed such that current selectively flows from the second contact strip 104 through the second contact member 94 and union 98 to the first contact member 92 and first contact strip 102.

It will further be recognized that from the foregoing description and with reference to FIGS. 5, 6, 7A, 7B, that as the pusher 30 moves along the track 34, the second contact member 94 will intermittently contact extensions 112 and openings 114. Accordingly, an electrical circuit will likewise be intermittently opened and closed as the pusher 30 moves along the track 34. The intermittent opening and closing can occur multiple times when a single product is removed, or a single time, depending upon the spacing of the contact extensions 112.

Figure 8:
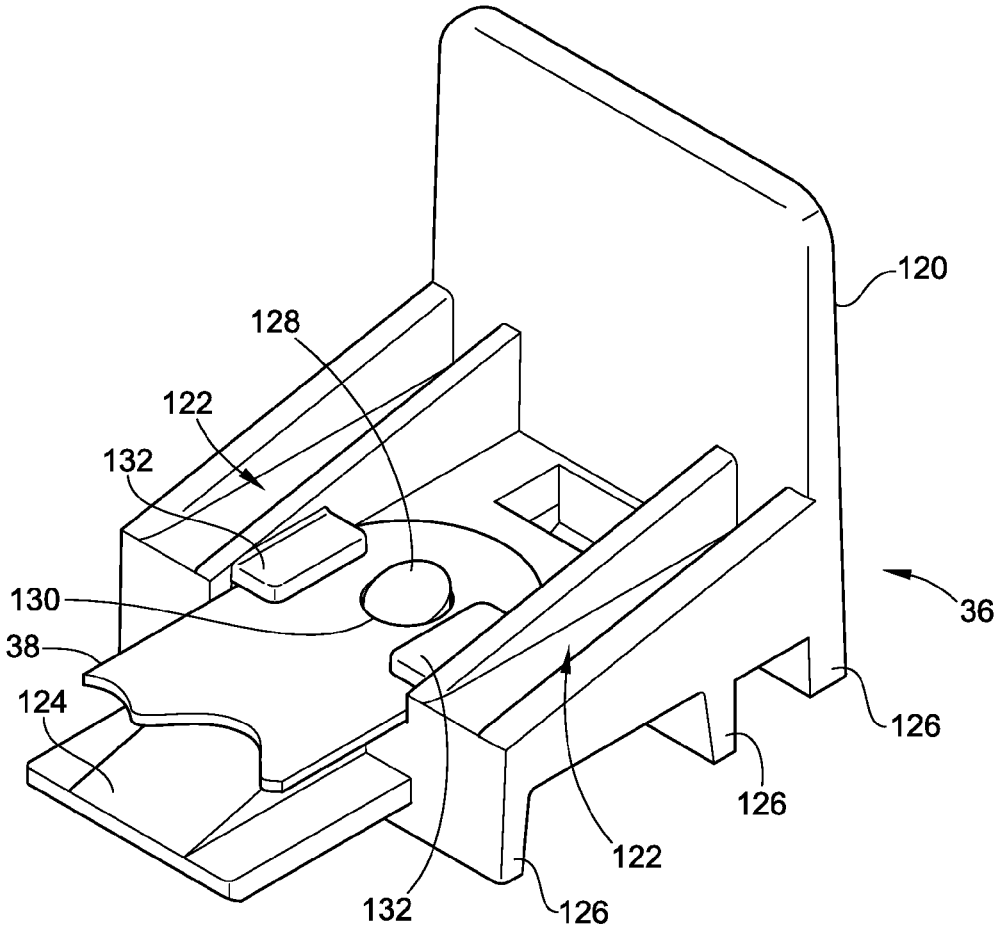
FIG. 8 is a perspective view of an end cap of the alarm sounding pusher of FIG. 1.

Referring back to FIG. 2, the end caps 36 maintain the contact board 44 within the pocket 54 of the track 34. As such, the contact board 44 remains fixed relative to the track 34 while the pusher 30 is free to move along the track 34 and relative to the contact board 44. The end caps 36 also function to affix the track 34 to the shelf mounts 40 (see FIG. 1). As illustrated in FIG. 2, the end caps 36 are generally symmetric such that one end cap 36 is not specific to a particular end of the track 34. With reference now to FIG. 8, the end cap 36 has a front stop 120. The front stop 120 functions as a barrier preventing retail merchandise 14 contained within the alarm sounding pusher system 10 from passing beyond the front stop 120 under the biasing action of the pusher 30 and biasing element 38. (See FIGS. 1, 2).

The end cap 36 can also incorporate ramped structures 122 to ramp retail merchandise 14 upward and away from the retail shelf 12 and towards the front stop 120. The end cap 36 also includes a tongue portion 124 that is dimensioned to fit within the pocket 54 and open bottomed channel 56 of the track 34 (see FIG. 2). The end cap 36 also has a plurality of support legs 126 vertically supporting the end cap 36. In the illustrated embodiment of FIG. 8, the end cap 36 has three support legs 126, however, more or fewer support legs 126 are contemplated.

Still referring to FIG. 8, the end cap 36 has a mounting post 128 dimensioned to receive an end 82 of the biasing element 38 and more particularly an opening 130 of the biasing element 38. The end cap 36 further includes a pair of retention flanges 132 to further facilitate the retention of the biasing element 38 once it is connected to the mounting post 128.

Figure 9:
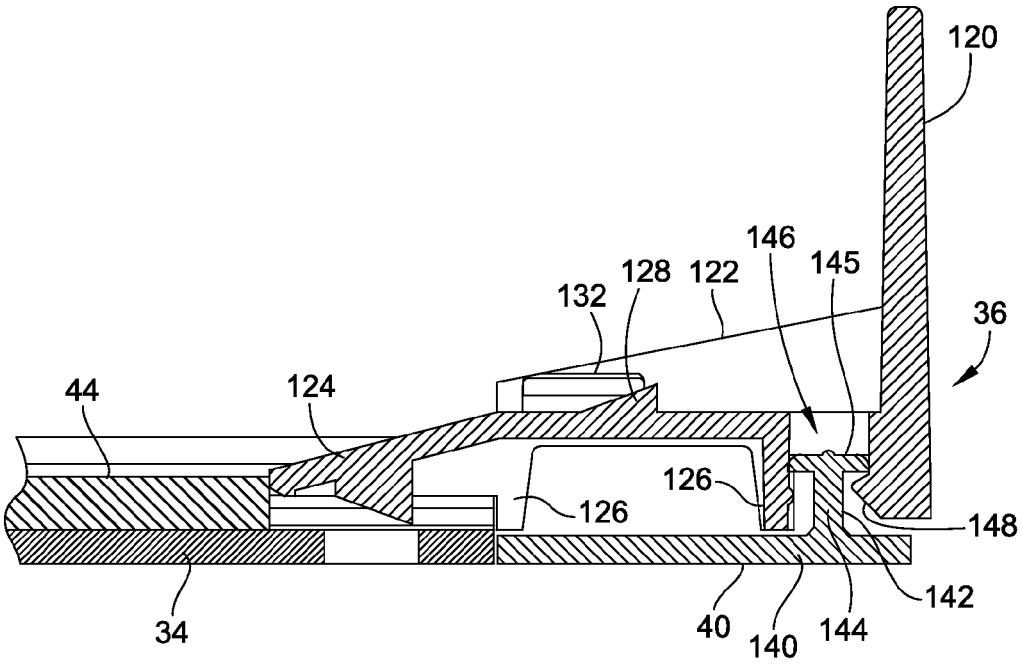
FIG. 9 is a partial side cross sectional view of the end cap, track, and contact board of FIG. 2.

Turning now to FIG. 9, as stated above, the end cap 36 interlocks with the shelf mount 40 (see FIG. 1). The shelf mount 40 includes a securement portion 140 that remains in surface contact with the shelf 12 (see FIG. 1). A rail 142 extends upwardly away from the securement portion 140. The rail 142 has a vertical support portion 144 and a flange 145. The rail 142 is dimensioned to be interfit within a channel 146 of the end cap 36. A locking tab 148 projects inwardly from the channel 146 to interlock with flange portion 145 of the rail 142.

Figure 10:
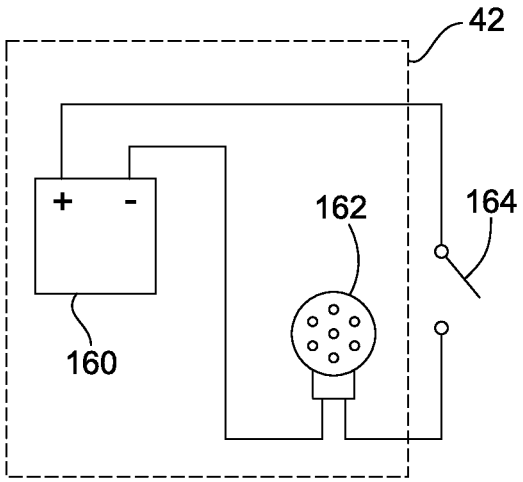
FIGS. 10-13 are schematic representations of various configurations of a tone generation module of the alarm sounding retail display system of FIG. 1.

Turning now to FIGS. 10-13, various configurations of the tone generation module 42 are illustrated. In FIG. 10, the tone generation module 42 includes a power source 160 and a tone generator 162. The alarm sounding pusher system 10 is schematically illustrated in FIG. 10 as a switch 164. When the switch 164 is in an open state as described above relative to FIG. 7A, current will not flow from the power source 160 to the tone generator 162 and therefore no audible tone will be emitted by the tone generator 162. However, when the switch 164 is in a closed position as discussed above with reference to FIG. 7B, current will flow from the power source 160 through the tone generator 162 and an audible tone will be generated thereby. As a result, the switch 164 acts as a sensor for the detection of current.

Figure 11:
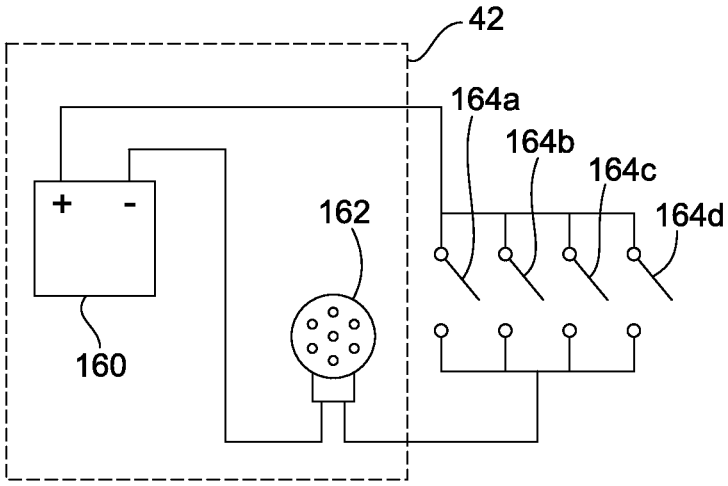

Turning now to FIG. 11, the control module 42 is operable to connect with multiple alarm sounding pusher systems 10 illustrated in FIG. 11 schematically as switches 164*a*-*d*. It will be recognized from examination of FIG. 11 that when any one of switches 164*a*-*d* are closed, an audible tone will generate from the tone generator 162 by way of electrical current flowing from the power source 160 to the tone generator 162. It will also be recognized that current will not flow when all of switches 164*a*-*d* are in an open state and thus no audible tone will generate from the tone generator 162.

Figure 12:
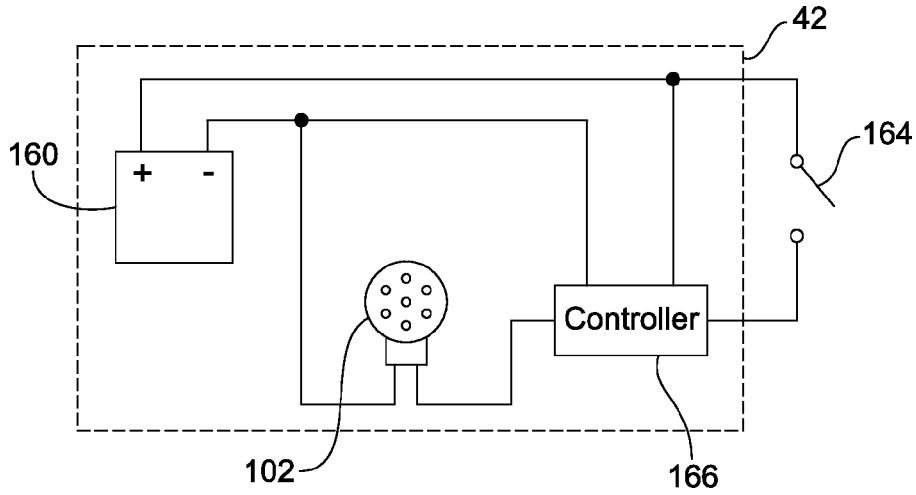

Turning now to FIG. 12, the tone generation module 42 can also include a controller 166. The controller 166 is operable to detect when the switch 164 transitions from an open to a closed state or from a closed to an open state by detecting the presence or absence of current. The controller 166 can be configured to allow power to be temporarily supplied to the tone generator 162 upon the detection of a change of state of the switch 164, i.e the electrical circuit formed between the pusher 30 and the contact board 44.

Figure 13:
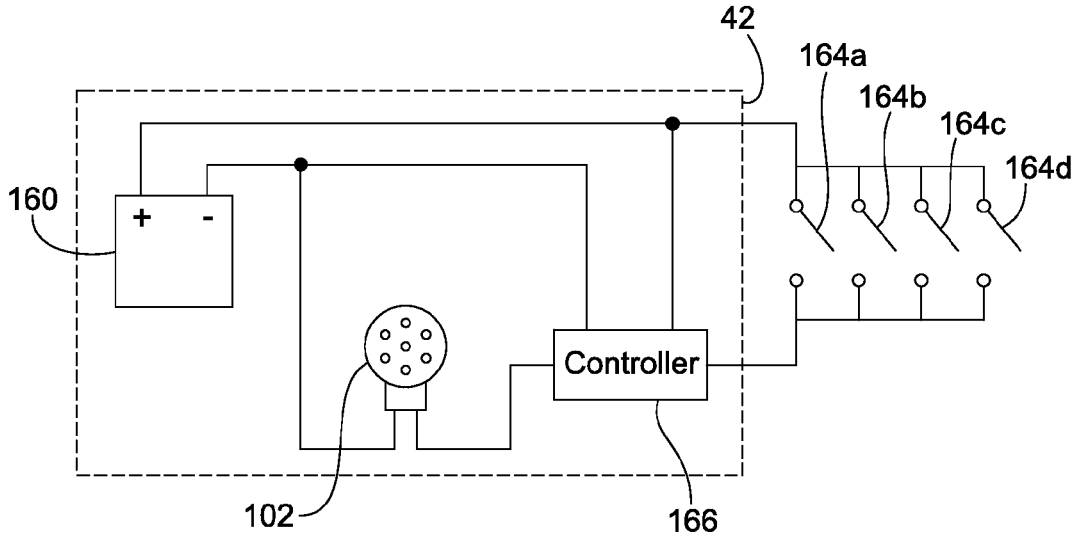

In certain embodiments, the controller 166 can be programmed to count a number of changes of state of the switch 164 before allowing power to be supplied to the tone generator 162. Additionally, the controller 166 can be programmed with a predetermined time period for the duration of power to be supplied to the tone generator 162 so as to govern the duration of the audible tone. With reference to FIG. 13, a similar configuration incorporating a controller 166 can also function with multiple alarm sounding pusher systems represented symmetrically by switches 164*a*-*d* similar to that as described above with respect to FIG. 11.

Despite the configuration selected, the tone generation module 42 is operable to provide an audible tone generally any time one or more items of retail merchandise 14 is removed, however, such functionality is not limiting on the invention. Indeed, as discussed above, the tone generation module 42 can incorporate a controller 145 such that various settings and configurations of tone generation are contemplated. As a result, various thresholds can be established to define the timing and manner of tone generation.

The audible tone provided by the tone generator 160 can take numerous forms. For example, the tone can be a continuous tone for a predetermined period of time, or discontinuous such that several tones are provided in rapid succession. For example, the tone generator may play a tone for 1-5 seconds and then automatically stop. Moreover, the tone generator 160 can play a pre-recorded message. Additionally, the tone generator 160 can play a tone that stays at a predetermined volume, or that escalates to a higher volume.

Additionally, the change of state of the electrical circuit formed by the pusher 30 and the contact board 44 can be used for other purposes not necessarily associated with playing the audible tone alone. For example, in other embodiments, when the controller 166 detects a change of state in the electrical circuit, it can also provide a visual indication as well as an audible tone. The visual indication may be, for example, an illumination of an LED light. Additionally, the controller 166 can be networked with a retail store's security camera system and control the operation of certain cameras to focus on the pusher system upon a change of state of the electrical circuit.

Figure 14:
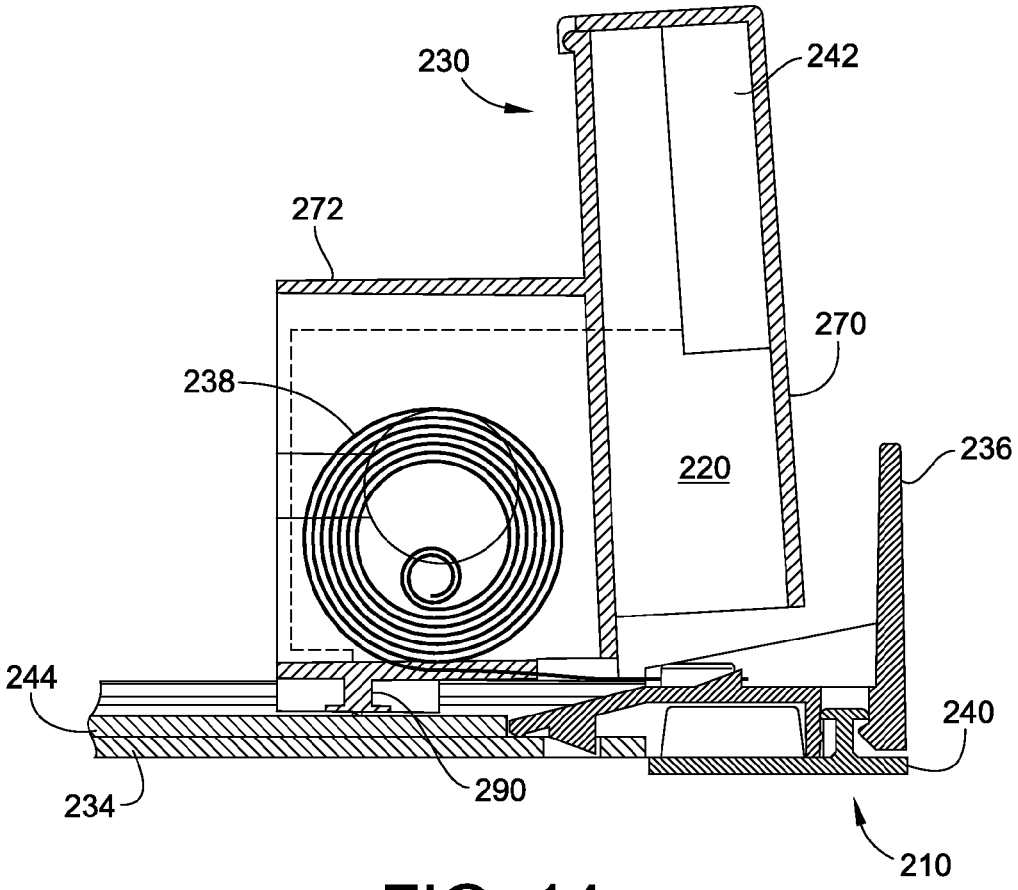
FIG. 14 is a partial side cross sectional view of an alternative embodiment of an alarm sounding retail display system of FIG. 1.

Turning now to FIG. 14, another embodiment of an alarm sounding retail display system embodied in an alarm sounding pusher system 210 is illustrated. In this embodiment, the tone generation module 242 is carried by the pusher 230 within a chamber 220 of the paddle 270 of the pusher 230. The alarm sounding pusher system 210 illustrated in FIG. 14 functions in a similar manner as that discussed above. More particularly, the alarm sounding pusher system 210 has a pusher 230 that contains a biasing element 238 within a housing 272. The biasing element 238 is connected to an end cap 236. The biasing element 238 pulls the pusher 230 towards the end cap 236. The pusher rides along and is guided by a track 234 as it is biased forward by the biasing element 238. The track 234 contains a contact board 244. The contact board 244 functions in a similar manner as discussed above with respect to contact board 44 in that it completes a circuit between the contact board 244, contact structure 290 and tone generation module 242.

In the illustrated embodiment, the tone generation module 242 is specific to the alarm sounding pusher system 210. However, in other embodiments, it is contemplated that one alarm sounding pusher system 210 can contain a tone generation module 242 and other alarm sounding pusher systems that otherwise do not contain a tone generation module 242 can be interconnected with the alarm sounding pusher system 210 to perform the functionality as described herein.

Figure 15:
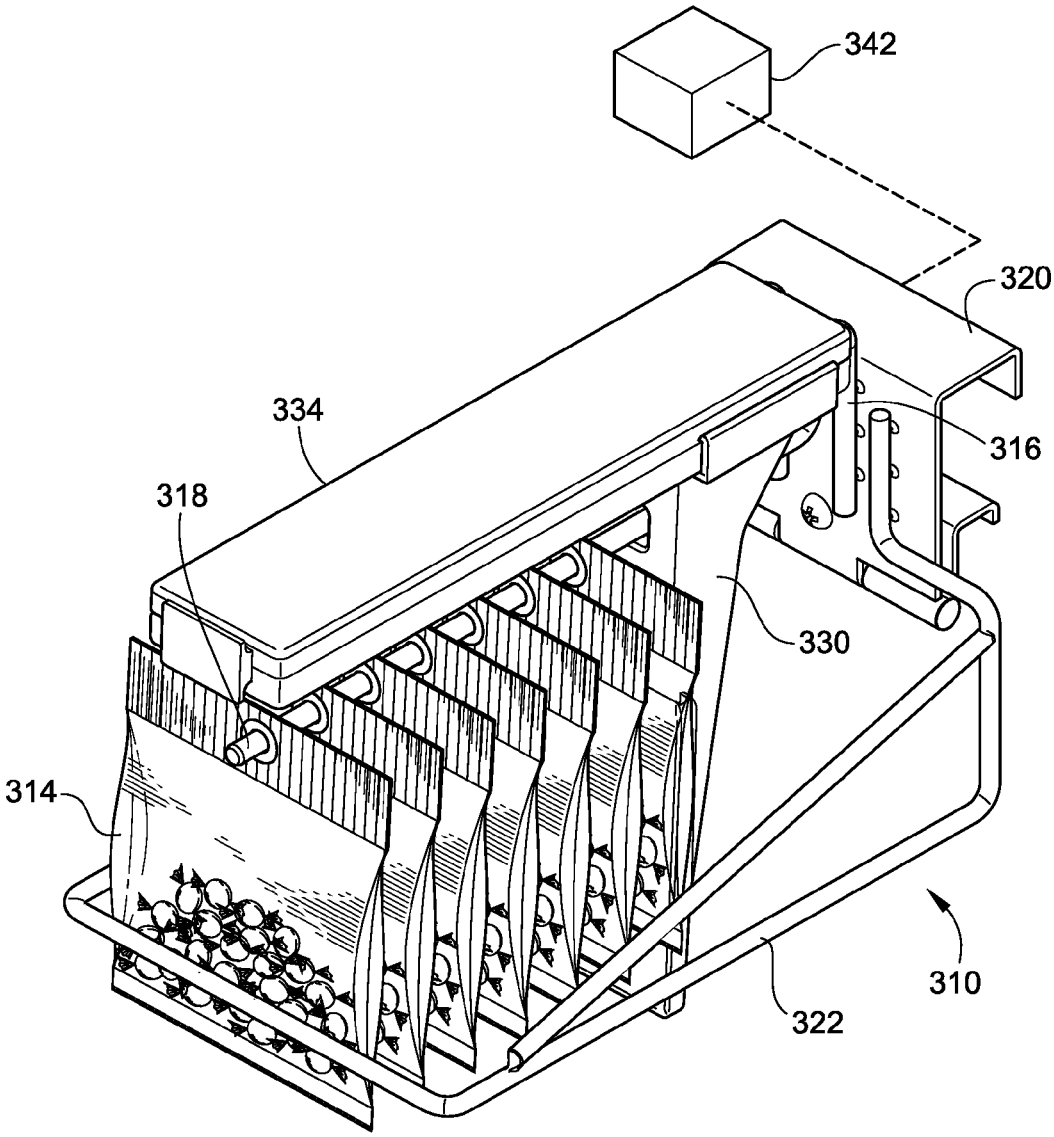
FIG. 15 is perspective view of a further embodiment of an alarm sounding retail display system.

Turning now to FIG. 15, another embodiment of an alarm sounding retail display system embodied in an alarm sounding pusher system 310 is illustrated. In this embodiment, a pusher 330 and track 334 are integrated with a retail hook 318 for hanging retail merchandise 314 therefrom. In a similar manner as discussed above, as the front most item of retail merchandise 314 is removed from the alarm sounding pusher system 310, the next item of retail merchandise 314 is biased forward by the pusher 330. More particularly, the pusher 330 is biased forward by a biasing element 338 contained within the pusher 330 (see FIG. 16).

Figure 16:
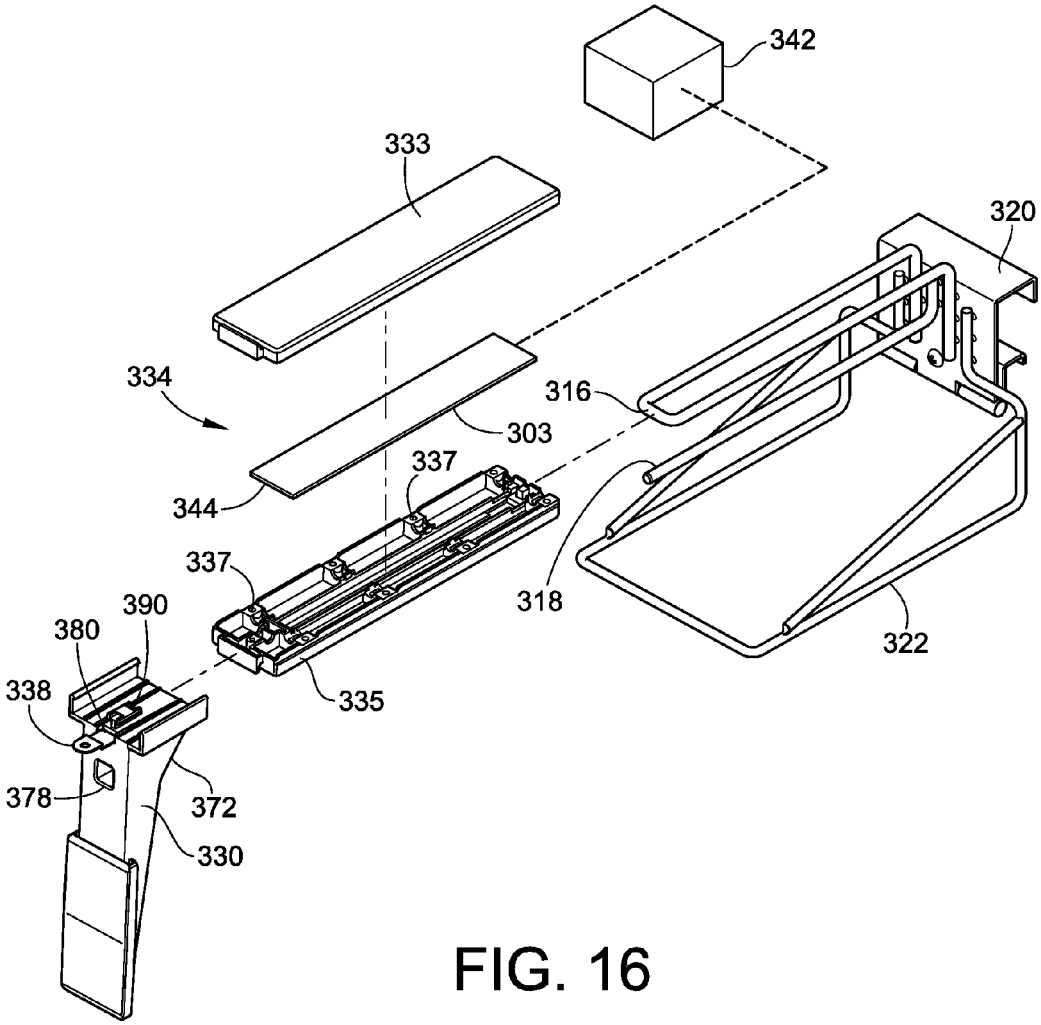
FIG. 16 is a perspective exploded view of the embodiment of FIG. 15.

With reference to FIG. 16, the track 334 is supported by a support frame 316 and is in electrical communication with a tone generation module 342. A retention frame 322 is also provided to retain the retail merchandise 314 on the hook 318 such that the pusher 330 cannot bias all of the retail merchandise 314 off of the hook 318. The retention frame 322 also prevents retail merchandise 314 (see FIG. 16) from being removed in groups during a retail theft scenario referred to as "sweeping".

The support frame 316, retail hook 318 and retention frame 322 are all fixedly attached to a mounting bracket 320. The mounting bracket 320 in turn is configured to mount to a retail structure such as a structure incorporating rigid wires, or any other structure sufficient to support the pusher system 310. Indeed, the mounting bracket 320 is not meant to limit the pusher system 310 to any particular environment. Still referring to FIG. 16, the track 334 is a split design having a first half 333 and a second half 335. The contact board 344 is contained between the first and second halves 333, 335. The first and second halves 333, 335 connect with one another via connections structures 337. The contact board 344 is contained within the track 334 such that a contact structure 390 of the pusher 330 can contact the contact board 344 in a similar manner as discussed above with respect to FIGS. 2-6.

Figure 17:
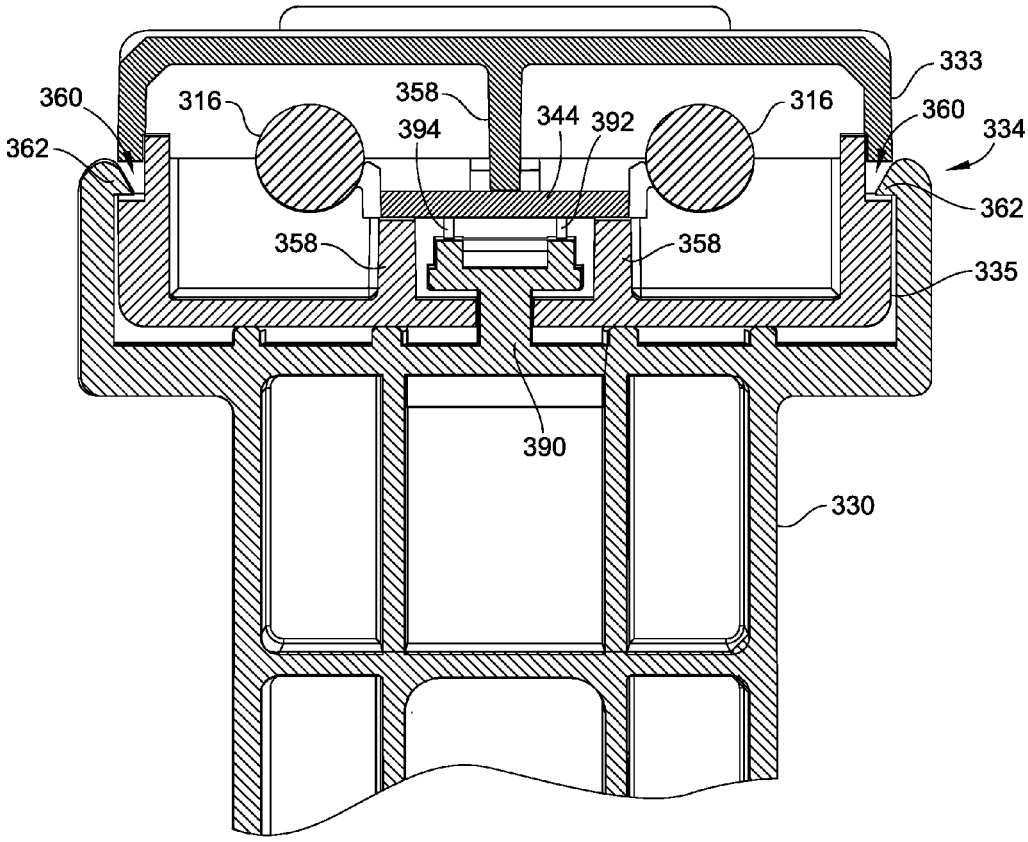
FIG. 17 is a back partial cross sectional view of a pusher, contact board, and track of the embodiment of FIG. 15.

More particularly and with reference now to FIG. 17, the contact structure 390 of the pusher 330 has a first contact member 392 and a second contact member 394. The first and second contact members 392, 394 contact first and second contact strips 302, 304 of the contact board 344 (see FIG. 19). The contact board 344 is maintained within the track 334 between the first and second halves 333, 335 thereof by contact board support structures 358. When the first and second halves 333, 335 of the track 334 are joined, the support structures 358 maintain the contact board 344 generally within the center of the track 334. Also when joined, the track 334 has a pair of guide grooves 360 dimensioned to receive inwardly extending guides 362 of the pusher 330.

Figure 18:
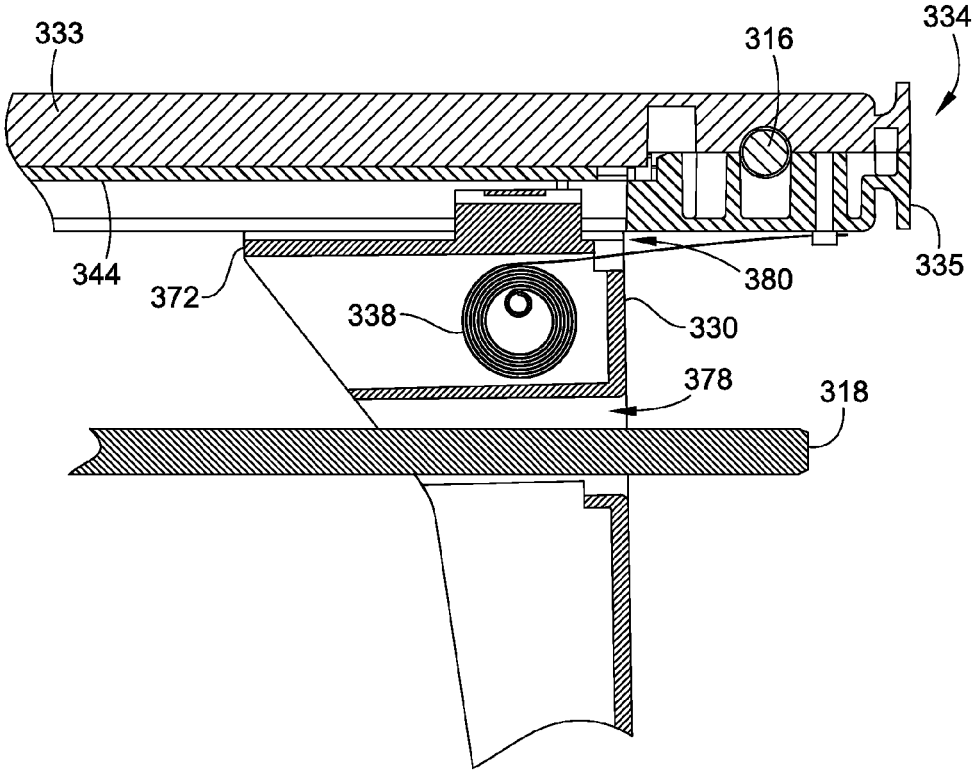
FIG. 18 is a side partial cross sectional view of a pusher, contact board, and track of the embodiment of FIG. 15.

Turning now to FIG. 18, the pusher 330 carries the biasing element 338 within a housing 372. The biasing element 338 extends through an opening 380 of the pusher 330 and mounts to the bottom half 335 of the track 334. As the pusher 330 is pulled away from the leading end of the track 334, the biasing element 338 acts to bias the pusher back toward the leading end of the track 334. The pusher 330 further has an opening 378 to allow the retail hook 318 to freely pass therethrough. It will be recognized from examination of FIG. 18 that as the pusher 330 is biased forward by the biasing element 338, it moves relative to the contact board 344, retail hook 318, and track 334.

Figure 19:
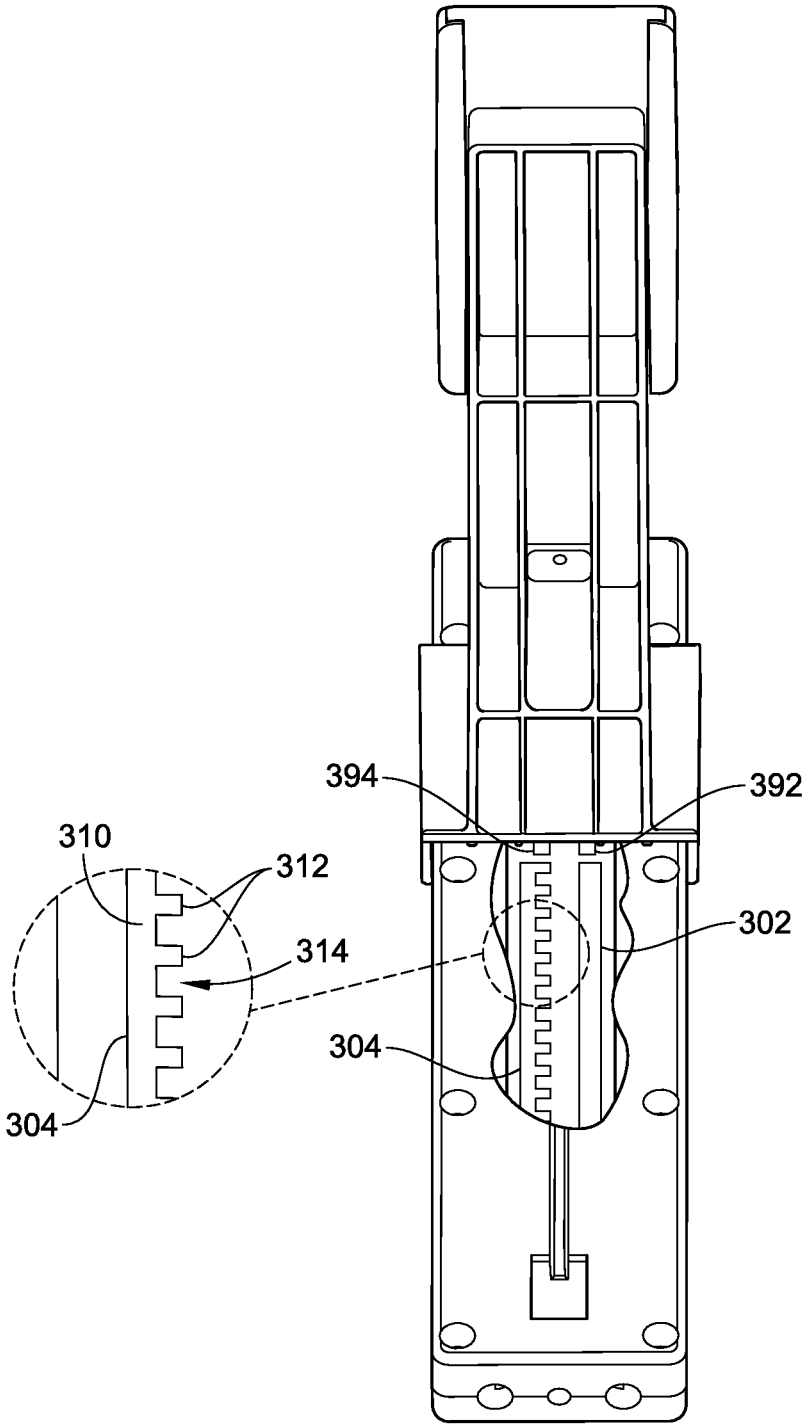
FIG. 19 is a back perspective view of the embodiment of FIG. 15 with the contact board partially exposed.

With reference now to FIG. 19, as the pusher 330 moves forward, the second contact member 394 is brought into intermittent contact with extensions 312 of the second contact member 304. As this occurs, a circuit formed with the contact board 344 and the tone generation module 342 (see FIG. 16) is likewise intermittently opened and closed. The tone generation module 342 will in turn provide an audible tone intermittently or under the operation of a controller also as described above.

Figure 20:
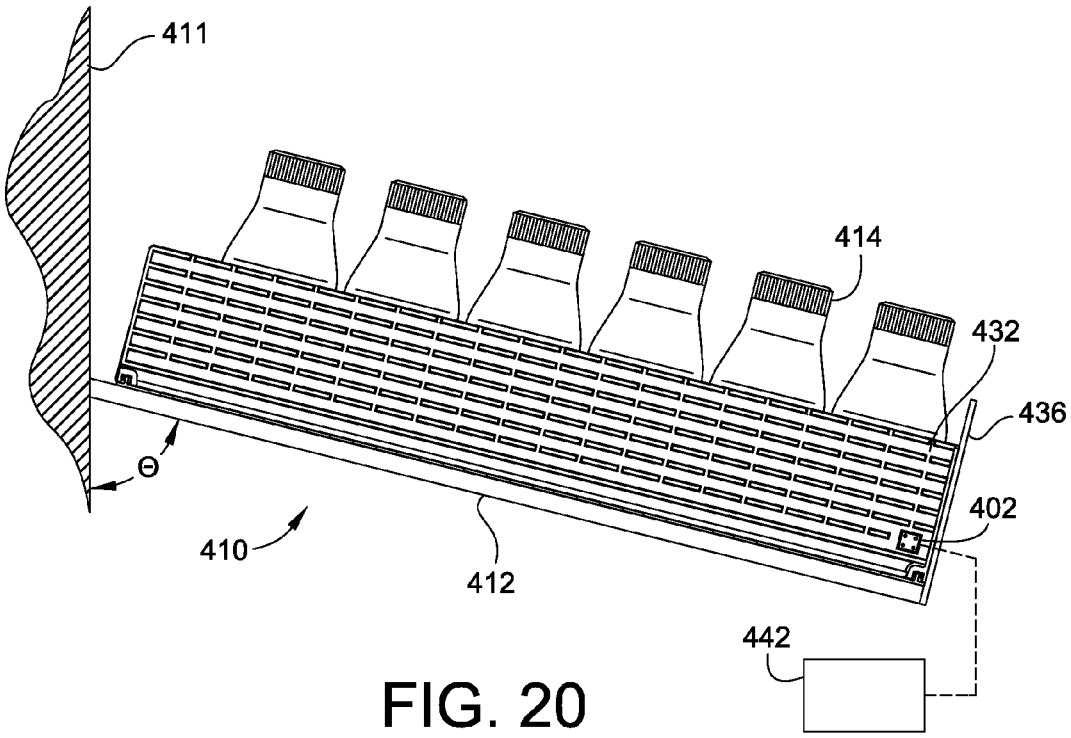
FIG. 20 is a side view of an exemplary embodiment of a retail display system in accordance with the teachings of the present invention.
Figure 21:
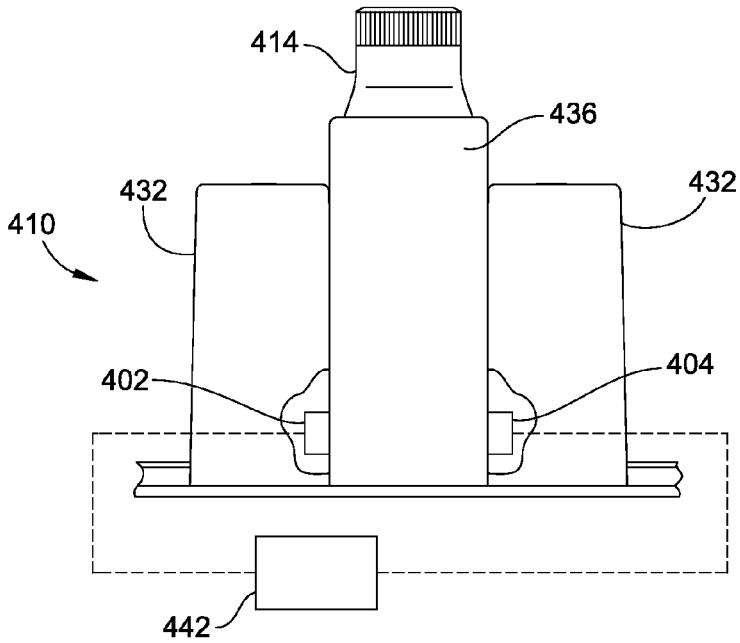
FIG. 21 is a front view of the retail display system of FIG. 20.

Turning now to FIGS. 20 and 21, another embodiment of an alarm sounding retail display system embodied as an alarm sounding gravity fed system 410 is illustrated. In the illustrated embodiment, a row of retail merchandise 414 is situated on a retail shelf 412 and contained between parallel dividers 432. As the leading item of merchandise 414 is removed, the row moves forward under gravity as a result of the angle θ formed between the shelf 412 and a support structure 411 supporting the shelf. The row moves forward until the next item 414, now the leading item 414, engages a front stop 436.

The gravity fed system 410 also includes a light source 402 and a light detector 404 defining a sensor. The light detector 404 is aligned with the light source 402 such that the leading item of retail merchandise 414 interrupts a beam of light emitted from the light source 402. When the leading item of merchandise is removed, the beam of light is detected by the light detector 404. Once detected, a signal is sent to a tone generation module 442, and an audible tone is generated in accordance with the description herein.

It will be recognized that in other embodiments, a light detector 404 could be used without an additional light source 402. In such an embodiment, the light detector 404 detects a change in lighting conditions in proximity to the detector 404 when the leading item of merchandise 414 is removed from the system 410.

Figure 22:
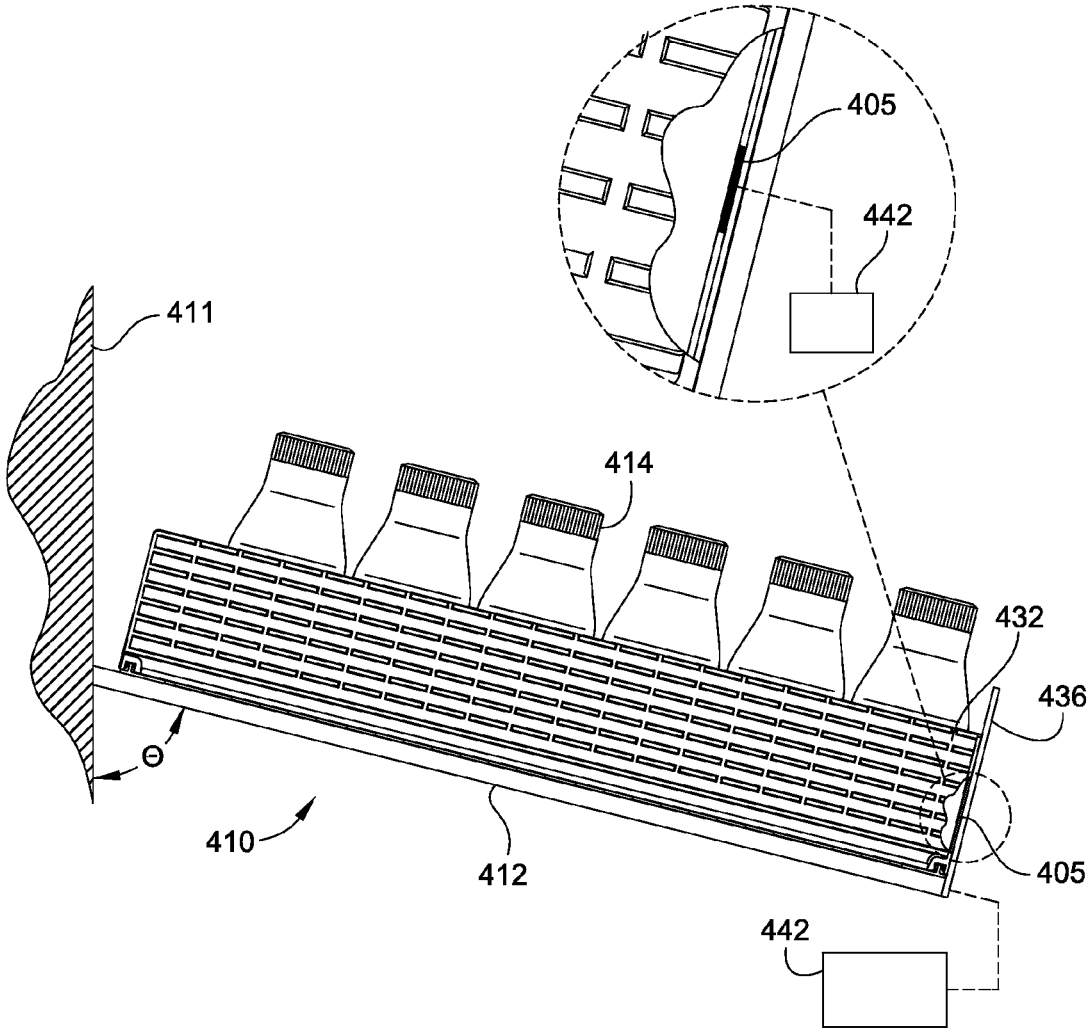
FIG. 22 is a side view of a further embodiment of the retail display system of FIG. 20.

Turning now to FIG. 22, in an alternative embodiment, a touch and/or a proximity sensor 405 can replace or supplement the light source 402 and light detector 404 configuration of FIGS. 20 and 21. In this embodiment, the leading item of retail merchandise 414 is in contact or proximity to the sensor 405. Once removed, the sensor sends a signal to the tone generation module 442, and an audible tone is generated in accordance with the description herein.

It will be recognized from the foregoing that certain embodiments of the invention do not contemplate the necessity of an additional product actuation mechanism in their respective operations. More specifically, product need only be manually added and/or removed to face more product forward, and to generate an audible tone. However, other embodiments can incorporate additional actuation systems. It is also contemplated that in certain embodiments, the system will provide an audible tone only after an item is actually removed, causing the remaining merchandise to move forward. However, in other embodiments, the system can provide an audible tone when an item is only partially removed, using sensors, controllers, and/or combinations thereof.

As described herein, embodiments of the alarm sounding pusher system provide an audible tone via a tone generation module upon movement of a pusher relative to a track. By providing this audible tone, would be shoplifter is deterred due to an impression of enhanced security because of the audible tone. Moreover, the audible tone functions to alert store employees in proximity to the alarm sounding pusher system that merchandise has been replaced or removed therefrom.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display system comprising:

a pusher, movable for facing retail merchandise;

a tone generation module in electrical communication with the pusher and operable to provide an audible tone upon removal of one or more items of merchandise from the retail display system;

wherein the tone generation module includes a tone generator and a power source, the power source providing power to the tone generator to generate the audible tone;

wherein the tone generation module includes a controller, the controller operable to detect the change of state and selectively apply power to the tone generator to provide the audible tone;

further comprising a track, the pusher slidable along the track, wherein the pusher carries the tone generation module;

wherein the pusher includes an electrical contact, and the track carries a contact board, the contact board having a first and a second contact strip, wherein the first and second contact strips are aligned with the contact of the pusher in a first position, and at least one of the first and second contact strips are not aligned with the contact in a second position.

2. The retail display system of claim 1 wherein the change of state of the electrical circuit is a change from open to closed.

3. The retail display system of claim 1 wherein the change of state of the electrical circuit is a change from closed to open.

4. The retail display system of claim 1 wherein the pusher includes a plurality of pushers, wherein each pusher is commonly connected to the tone generation module.

5. The retail display system of claim 4, wherein removal of items from any of the plurality of pushers generates a tone from the one tone generation module.

6. The retail display system of claim 1, wherein the tone generation module is self contained and dedicated to a retail display unit, not in communication externally from the retail display unit.

7. A retail display system for facing retail merchandise contained therein, comprising:

a pusher having a first electrical contact;

a track carrying a second electrical contact, the first contact selectively alignable with the second contact to complete an electrical circuit;

a tone generation module operable to provide an audible tone upon at least one of the alignment and misalignment of the first and second contacts;

wherein the first contact extends from a bottom of the pusher, the track having an opening configured to receive the first contact, the second contact carried within a pocket of the track, the first contact extending through the opening and into the pocket to contact the second contact; and wherein the second contact is a contact board, the contact board having a first and a second contact strip carried by a non-conductive base of the contact board.

8. The retail display system of claim 7, wherein the first contact strip is a continuous strip of conductive material and the second contact strip is a strip of conductive material having a base portion and a plurality of spaced apart extensions, wherein a portion of the non-conductive base is disposed between each spaced apart extension.

9. The retail display system of claim 8 wherein the first contact has a first contact member, a second contact member, and a union extending therebetween and conductively joining the first and second contact members, the first contact member aligned with the first contact strip, the second contact member aligned with the second contact strip such that the second contact member intermittently contacts the plurality of extensions and the portion of the non-conductive base between the plurality of extensions.

10. The retail display system of claim 9, wherein electrical current flows through the first contact member, second contact member, and the union when the second contact member is in contact with one of the plurality of extensions, and wherein the first contact strip is electrically insulated from the second contact strip when the second contact member is disposed between two adjacent extension of the plurality of extensions of the second contact strip, the second contact member in contact with one of the plurality of extensions when at least one item of retail merchandise is removed from the retail display system.

11. The retail display system of claim 7 wherein the pusher and track are situated upon a retail shelf.

* * * * *